US006664218B1

(12) United States Patent
Dastbaz et al.

(10) Patent No.: US 6,664,218 B1
(45) Date of Patent: Dec. 16, 2003

(54) CLEANING COMPOSITION CONTAINING A HYDROPHILIZING POLYMER

(75) Inventors: Nathalie Dastbaz, Liege (BE); Eric Ewbank, Fontaine-Chaalis (FR)

(73) Assignee: Colgate-Palmolive Co, Piscataway, NJ (US)

( * ) Notice: Subject to any disclaimer, the term of this patent is extended or adjusted under 35 U.S.C. 154(b) by 0 days.

(21) Appl. No.: 10/245,155

(22) Filed: Sep. 17, 2002

(51) Int. Cl.[7] ..... C11D 17/00

(52) U.S. Cl. ..... 510/180; 510/181; 510/182; 510/238; 510/475; 510/476; 510/480; 510/586; 510/490

(58) Field of Search ..... 510/180, 182, 510/181, 238, 475, 476, 480, 506, 490

(56) References Cited

U.S. PATENT DOCUMENTS

| | | | | |
|---|---|---|---|---|
| 6,281,180 | B1 * | 8/2001 | Tartakovsky et al. | 510/220 |
| 6,569,261 | B1 * | 5/2003 | Aubay et al. | 134/39 |
| 2003/0148907 | A1 * | 8/2003 | Black | 510/230 |

FOREIGN PATENT DOCUMENTS

| | | |
|---|---|---|
| DE | 2161591 | * 12/1971 |
| WO | 00/77143 | * 12/2000 |

* cited by examiner

*Primary Examiner*—Necholus Ogden
(74) *Attorney, Agent, or Firm*—Richard E. Nanfeldt

(57) ABSTRACT

The present invention relates to a cleaning composition containing a zwitterionic surfactant, a glycol ether cosurfactant, a hydrophilizing polymer and water.

3 Claims, No Drawings

CLEANING COMPOSITION CONTAINING A HYDROPHILIZING POLYMER

FIELD OF INVENTION

The present invention relates to cleaning composition for hard surfaces, wherein the composition includes a zwitterionic surfactant, a glycol ether cosurfactant, a hydrophilizing polymer which is a quaternized ammonium acrylamide/acrylic acid copolymer and water.

BACKGROUND OF THE INVENTION

Numerous cleaning compositions have been disclosed in various patents. However, a major problem with these cleaning compositions is that the surface exhibits water-marks, smear or spots, when the surface is treated with the cleaning composition and subsequently dried.

U.S. Pat. No. 5,759,986 describes a cleaning composition which allegedly reduces spotting. These compositions employ a silicon polymer and a polymer which makes the treated surface hydrophilic.

DE-A-2161591 teaches a cleaning composition which contains an amino containing polymer.

WO00/77143A1 describes a surface substantive polymer which makes the treated surface hydrophilic, wherein the polymer is a copolymer of N-vinylimidazole N-vinylpyrrolidone (PVPVI), a quaternized vinyl pyrrolidone/dialkylaminoalkyl acrylate or methacrylate copolymer, or a polyvinyl pyridine N-oxide polymer.

SUMMARY OF THE INVENTION

The present invention relates to a hard surface cleaning composition comprising a zwitterionic surfactant, a hydrophilizing copolymer which is a quaternized ammonium acrylamide/acrylic acid copolymer, a glycol ether cosurfactant and water, wherein the composition does not contain anionic surfactants, nonionic surfactants containing ethoxylate groups, silicon containing polymers, amino containing polymers, copolymers of N-vinylimidazole N-vinylpyrrolidone (PVPVI), or quaternized vinyl pyrrolidone/dialkylaminoalkyl acrylate or methacrylate copolymers, or polyvinyl pyridine N-oxide polymers.

The object of the instant invention is to formulate a liquid cleaning composition for cleaning of various soils on hard surfaces while preventing this surfaces from further soil build-up.

It is an object of the instant invention to deliver a cleaning composition for removal of calcium deposits on hard surfaces such as limescale or soap scum.

It is an object of the instant invention to provide a cleaning composition, wherein the hydrophilizing polymer renders the treated surface hydrophilic after application of the product without rinsing or wiping.

A further object of the instant invention is to provide a cleaning composition which reduces the formation of streaks, water-marks, smear and spots, after the surface has been treated with the cleaning composition and subsequently dried without rinsing or wiping.

It is thus a further object of the instant invention to prevent the build-up of soap scum (e.g. calcium oleate) after the surface has been treated with the cleaning composition and subsequently dried without rinsing or wiping.

DETAILED DESCRIPTION OF THE INVENTION

The present invention relates to a ceramic or glass cleaning composition which renders the surface being treated hydrophilic, wherein the composition comprises approximately by weight:

(a) 0.1% to 10% of a zwitterionic surfactant;

(b) 0.01% to 2% of a hydrophilizing polymer which is quaternized ammonium acrylamide/acrylic acid copolymer such as diallyl dimethyl ammonium acrylamide/acryl acid copolymer having a molecular weight of about 1,000 to about 20,000,000 preferably 10,000 to 10,000,000.

(c) 0.1% to 10% of a glycol ether cosurfactant and/or a short chain alkanol; and (d) the balance being water, wherein the composition does not contain an anionic surfactant, an amino containing polymer, a silicon containing polymer, a nonionic surfactant containing ethoxylate groups, N-vinylimidazole N-vinylpyrrolidone (PVPVI), or quaternized vinyl pyrrolidone/dialkylaminoalkyl acrylate or methacrylate copolymers, or polyvinyl pyridine N-oxide polymers.

The water-soluble zwitterionic surfactant, which is present in the liquid composition is a water soluble betaine having the general formula:

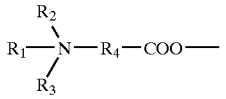

wherein $R_1$ is an alkyl group having 10 to 20 carbon atoms, preferably 12 to 16 carbon atoms, or the amido radical:

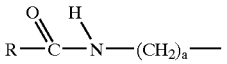

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonio) acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

The quaternized ammonium acrylamide/acrylic acid copolymer such as diallyl dimethyl ammonium acrylamide/acrylic acid copolymers of interest for the instant invention are for instance material produced by Rhodia under the tradename Mirapol Surf S. A more preferred polymer is Mirapol Surf-S210.

Representative members of the glycol ethers cosurfactants are selected from the group consisting of ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate and mixtures thereof.

The composition can contain a short chain alkanol in place of the glycol ether cosurfactant or in combination with the glycol ether cosurfactant. Preferred short chain alcohols are ethanol and isopropyl alcohol or a mixture thereof.

Other ingredients which have been added to the compositions at concentrations of 0.1 to 4.0 wt. % are preservatives such as DMDMH, mixture of isothiazolones, sodium formate and Bronidox.

Additionally, there may be used various additives such as dyes and perfumes; ultraviolet light absorbers such as the Uvinuls, which are products of GAF Corporation; chelating agents such as ethylene diamine tetraacetates EDTA, HEDTA, D,L-Aspartic acid, N-(1,2-dicarboxyethyl)-tetrasodium salt (IDSNa), magnesium sulfate heptahydrate; pearlescing agents and opacifiers; pH modifiers; etc. The proportion of such additives, in total will normally not exceed 15% of weight of the detergent composition, and the percentages of most of such individual components will be a maximum of 5% by weight and preferably less than 2% by weight. Sodium bisulfite can be used as a color stabilizer at a concentration of 0.01 to 0.2 wt. %.

The instant compositions are readily made by simple mixing methods from readily available components.

The following examples illustrate liquid cleaning compositions of the described invention. The exemplified compositions are illustrative only and do not limit the scope of the invention. Unless otherwise specified, the proportions in the examples and elsewhere in the specification are by weight.

DESCRIPTION OF THE PREFERRED EMBODIMENTS

EXAMPLE 1

The following formula was prepared at room temperature by simply liquid mixing procedures:

| | Wt. % | Water (Reference) |
|---|---|---|
| Mirapol S 210[1] | 0.5 | |
| Cocoamido propyl dimethyl betaine | 3.5 | |
| PnB | 1.5 | |

-continued

| | Wt. % | Water (Reference) |
|---|---|---|
| Ethanol | 1.5 | |
| Perfume | 0.15 | |
| IDSNa | 0.9 | |
| DMDMH | 0.45 | |
| Water | Bal. | |
| Soap scum removal (A) | Rating 4 | Rating 0 |
| Soap scum prevention (B) | Rating 4 | Rating 0 |

[1]Mirapol Surface S 210 is a diallyldimethyl ammonium acrylamide/acrylic copolymer supplied by Rhodia.

The above disclosed composition delivers excellent soap scum removal performance while preventing from further soap scum build up.

(A).Soap Scum Removal Test Method

This test procedure aims to reproduce in the laboratory the soap scum deposit that consumers find in their bathroom (on their bathtub, sinks, shower . . . ) on tiles. The cleaning efficacy of the product is evaluated against water using a straight-line washability machine. A rating from 0 to 5 is assigned for each tested tile (0: no removal, 5: no soil remaining). This can be evaluated by human visual grading.

(B).Soap Scum Prevention

The aim of this test is to demonstrate the soap scum build-up prevention of bathroom cleaner. On white ceramic tiles, colored soap scum is applied after treatment with the product to test. If the product acts, the colored soil disappear leaving the tile cleaner and whiter compared to tiles that have been treated with water. A rating from 0 to 5 is assigned for each tested tile (0:no prevention, 5:no soil build-up). This can be evaluated by human visual grading.

What is claimed:

1. A hard surface cleaning composition comprising approximately by weight:

(a) 0.1% to 10% of a zwitterionic surfactant;

(b) 0.01% to 2% of a diallyl dimethyl ammonium acrylamide/acrylic acid copolymer; and (c) the balance being water wherein the composition does not contain anionic surfactants, nonionic surfactants containing ethoxylate groups, silicon containing polymers, amino containing polymers, copolymers of N-vinylimidazole N-vinylpyrrolidone, or quaternized vinylpyrrolidone/dialkylaminoalkyl acrylate or methacrylate copolymers, or polyvinyl pyridine N-oxide polymers.

2. A cleaning composition according to claim 1 further including at least one glycol ether cosurfactant.

3. A cleaning composition according to claim 2 further including a $C_1$–$C_4$ alkanol.

* * * * *